US006220391B1

(12) United States Patent
White

(10) Patent No.: US 6,220,391 B1
(45) Date of Patent: Apr. 24, 2001

(54) SCAFFOLDING STRUCTURE

(75) Inventor: Bethel Y. White, Sevierville, TN (US)

(73) Assignee: WCM Development Company, Friendsville, TN (US)

( * ) Notice: Subject to any disclaimer, the term of this patent is extended or adjusted under 35 U.S.C. 154(b) by 0 days.

(21) Appl. No.: 09/413,841

(22) Filed: Oct. 6, 1999

Related U.S. Application Data

(63) Continuation-in-part of application No. 09/094,784, filed on Jun. 15, 1998, now abandoned, which is a continuation-in-part of application No. 08/811,379, filed on Mar. 4, 1997, now Pat. No. 5,810,114.

(51) Int. Cl.[7] ..... E04G 7/00

(52) U.S. Cl. ..... 182/178.5; 182/178.1; 182/129

(58) Field of Search ..... 182/178.5, 222, 182/186.7, 178.1, 113, 179.1, 119, 130, 129

(56) References Cited

U.S. PATENT DOCUMENTS

| | | | | |
|---|---|---|---|---|
| 2,738,832 | * | 3/1956 | Torkelson . | |
| 2,833,596 | * | 5/1958 | Borgman | 182/132 |
| 2,872,251 | * | 2/1959 | Crosby | 182/132 |
| 3,021,919 | * | 2/1962 | Peters | 182/178.1 |
| 4,480,819 | * | 11/1984 | Lopez | 182/113 |

FOREIGN PATENT DOCUMENTS

| | | | | |
|---|---|---|---|---|
| 872850 | * | 4/1953 | (DE) | 182/179.1 |
| 150915 | * | 6/1983 | (DE) | 182/129 |
| 1261889 | * | 4/1961 | (FR) | 182/178.1 |
| 1316387 | * | 4/1964 | (FR) . | |

* cited by examiner

*Primary Examiner*—Alvin Chin-Shue
(74) *Attorney, Agent, or Firm*—Luedeka, Neely & Graham, P.C.

(57) ABSTRACT

A scaffolding structure is configured to provide dual walk-through areas with each walk-through area being at different elevations of a scaffolding section. Each section of the scaffolding structure includes two end frames with each end frame having a forward column, a center column, and a rearward column. The forward and center columns are connected by a walk board support and the center and rearward columns are connected by a work board support. The end frames are interconnected by a walk board joined at one end with the walk board support of one end frame and joined at the other end with the walk board support of the other end frame. A work board also interconnects the end frames in similar fashion with one end of the work board joined with the work board support of one end frame and the other end of the work board joined with the work board support of the other end frame. Cross-bracing of the end frames relative to each other and a handrail connected between the rearward columns of the end frames are employed as needed. Receptors in the ends of the forward, center, and rearward columns are configured to closely receive a stud to enable multi-level, vertical stacking of like scaffolding sections. Electrical outlets are provided at the center column of the end frames. An electrical conduit positioned within the center column provides electrical continuity between an electrical power source and the outlets. Jumpers are employed to establish continuity between adjacent vertical scaffolding sections. A substantially non-load bearing ladder may be attached to one or more of the end frames. A corner walk board and a corner work board are provided to achieve continuous scaffolding around comers of structures.

18 Claims, 8 Drawing Sheets

SCAFFOLDING STRUCTURE

This is a continuation-in-part of application Ser. No. 09/094,784, filed Jun. 15, 1998, abandoned which is a continuation-in-part of application Ser. No. 08/811,379, filed Mar. 4, 1997, U.S. Pat. No. 5,810,114 issued Sep. 22, 1998.

TECHNICAL FIELD

The present invention relates to the field of scaffolding. More specifically, this invention relates to an improved scaffolding system which may be more quickly and efficiently raised and which provides greater utility than conventional scaffolding systems.

BACKGROUND

In the field of construction and maintenance of structures, scaffolding is typically required in order to place workers and materials at elevated work areas. The scaffolding is vertically erected alongside the building and may include several levels, as dictated by the heights which must be reached, with each level serving as a platform for support of workers and materials. When work is completed, the scaffolding is removed or disassembled as it is no longer needed.

Scaffolding is by definition a temporary structure, and many forms of prefabricated scaffolding are available to provide a reusable scaffolding system for scaffolding users. A type of prefabricated scaffolding commonly used in construction of buildings, for example, includes end frames having two support columns with a horizontal cross-bar connecting the two scaffolding columns at the upper ends of the columns. Walk boards, typically in the form of wooden planks, are simply laid across the horizontal cross-bars of adjacent end frames so that one end of a plank rests upon the cross-bar of one end frame with the other end of the plank resting on the cross-bar of an adjacent end frame. Successive ones of the end frames are connected to one another by cross-bracing each support column of each end frame to corresponding support columns of adjacent end frames. Planks are typically longer than the distance from end frame to end frame so the plank overlaps the end frame to some degree.

Several undesirable consequences result from this approach. For example, a scaffolding structure as described above exhibits limited utility since the cross-braces on the working side of the scaffolding (i.e., the side which faces the building under construction) represent an obstacle which inhibits access to the building by workers. To avoid the cross-braces, workers often remove them and thereby compromise the structural integrity of the scaffolding in order to improve access to the building. The necessary placement of workers and materials at the same level of the scaffolding structure further restricts the worker's ability to move freely about, creating an additional hazardous condition for the worker and others.

Scaffolding of the type described above is also structurally unstable when workers and materials are placed at higher levels of the scaffolding structure. Forces exerted at upper levels of the structure, such as the effect of wind, movement of workers and materials, and the like, can easily exceed the scaffolding's limits, causing it to topple. To prevent such an occurrence, it is common practice to secure the scaffolding by chain or rope to the building itself whenever possible.

Another difficulty with the use of conventional scaffolding structures is that they are difficult and hazardous to ascend and descend. Truss members used for adding structural strength between the columns and cross-bar are often used by workers for climbing the scaffolding. However, these truss members are load-bearing members of the scaffolding end frame and are not designed to meet applicable industry standards (including OSHA standards) for climbing apparatus. Overlapped planks are also a safety hazard since workers can trip over the ends of the planks or upend a plank by stepping on the overhang.

Still another problem arising from the use of conventional scaffolding is most prevalent in higher scaffolding where electrical tools are required. In such instances, electrical lines are extended from the ground to the level at which electrical power is required. However, dangling electrical lines tend to be pulled downward by the effects of gravity and other forces, resulting in an inconvenience to the worker and a hazard to equipment and other workers at lower levels.

The following list of U.S. Patents represent scaffolding types which are typical of the art.

| U.S. Pat. No. | Inventor(s) | Issue Date |
|---|---|---|
| 2,305,563 | R. A. Uecker, et al. | Dec. 15, 1942 |
| 2,449,069 | H. A. Harrison | Sep. 14, 1948 |
| 2,555,782 | R. G. Brownstein | Jun 5, 1951 |
| 3,726,362 | J. D. Puckett | Apr 10, 1973 |
| 4,391,348 | R. L. Rieland | Jul 5, 1983 |
| 4,430,839 | G. Buffers | Feb 14, 1984 |
| 4,891,926 | D. Alenbaugh | Jan 9, 1990 |
| 5,388,661 | R. Hood, Jr. | Feb 14, 1995 |
| 5,400,870 | S. Inoue | Mar 28, 1995 |
| 5,412,913 | H. F. Daniels, et al. | May 9, 1995 |

None of these scaffold structures solve the problems discussed above.

What is needed, therefore, is an easily assembled scaffolding structure which enhances the placement, access, movement, and safety of workers and materials at elevated work areas.

SUMMARY

With regard to the foregoing and other objects, the invention in one aspect provides a scaffolding end frame having a forward scaffolding column, a center scaffolding column nonremovably attached to the forward column, and a rearward scaffolding column nonremovably attached to the center column. Each of the columns lie in a common plane and are of unibody construction with a lower end in opposed relation to an upper end. The upper and lower ends of each column include means for connecting the column to an upper or lower end of a corresponding column of a further end frame so that the end frames can be vertically stacked to form a multi-level scaffolding structure.

Preferably, the forward, center, and rearward columns are substantially parallel to each other. Also preferably, each scaffolding column is substantially the same length.

The end frame may also include a board support member nonremovably attached to the forward scaffolding column and the center scaffolding column. A board support member may also be attached to the center scaffolding column and the rearward scaffolding column. The board support members are configured to receive and support a substantially planar scaffolding board. Board support members may also be provided at different heights as measured from the lower ends of the columns.

A ladder may be attached to one or more of the end frames to assist workers in ascending and descending the scaffolding structure. In a preferred embodiment, the ladder is substantially non-load bearing such that the absence of the ladder imposes substantially no effect to the structural integrity of the first end frame. The ladder is also preferably constructed to meet applicable industry standards, such as OSHA.

Electrical power may be provided to the end frame by including an electrical carrier attached to one of the scaffolding columns. An electrical conduit disposed within the column provides electrical continuity between a power source and the electrical outlet.

The present invention also provides a scaffolding structure having first and second end frames with each end frame having an upper end and a lower end. Each end frame includes forward, center, and rearward columns having substantially the same length. A walk board having opposed ends interconnects the two end end frames at a first distance from the lower ends of the end frames. A work board having opposed ends also interconnects the two end frames, but at a second distance from the lower ends of the end frames with the second distance being greater than the first distance. Means are provided for cross-bracing the first end frame relative to the second end frame. Vertical stacking of like end frames is preferably accomplished by providing a plurality of receptors in the upper and lower ends of the end frames which receive a plurality of studs interconnecting with other like end frames.

In a preferred embodiment, cross-bracing may be provided by a cross-brace having opposed ends with one end of the cross-brace attached to the rearward scaffolding column of the first end frame and the other end of the cross-brace attached to the rearward scaffolding column of the second end frame.

Each end frame also preferably includes a walk board support nonremovably attaching the forward and center columns and a work board support nonremovably attaching the center and rearward columns, as described above. The walk board support is configured to receive an end of the walk board so that the ends of the walk board may be joined with their respective walk board support members of the two end frames at said first distance from the lower ends of the end frames. Similarly, the work board support is configured to receive an end of the work board so that the ends of the work board may be joined with their respective walk board support members of the two end frames at said second distance from the lower ends of the ends frames. Stiffener plates may be attached to the ends of each walk board and work board to reduce board flexure and to provide a wear-resistant interface between the board and its support member.

BRIEF DESCRIPTION OF THE DRAWINGS

The above and other features, aspects and advantages of the present invention will now be discussed in the following detailed description and appended claims considered in conjunction with the accompanying drawings in which:

DETAILED DESCRIPTION OF PREFERRED EMBODIMENTS

Figure 1:
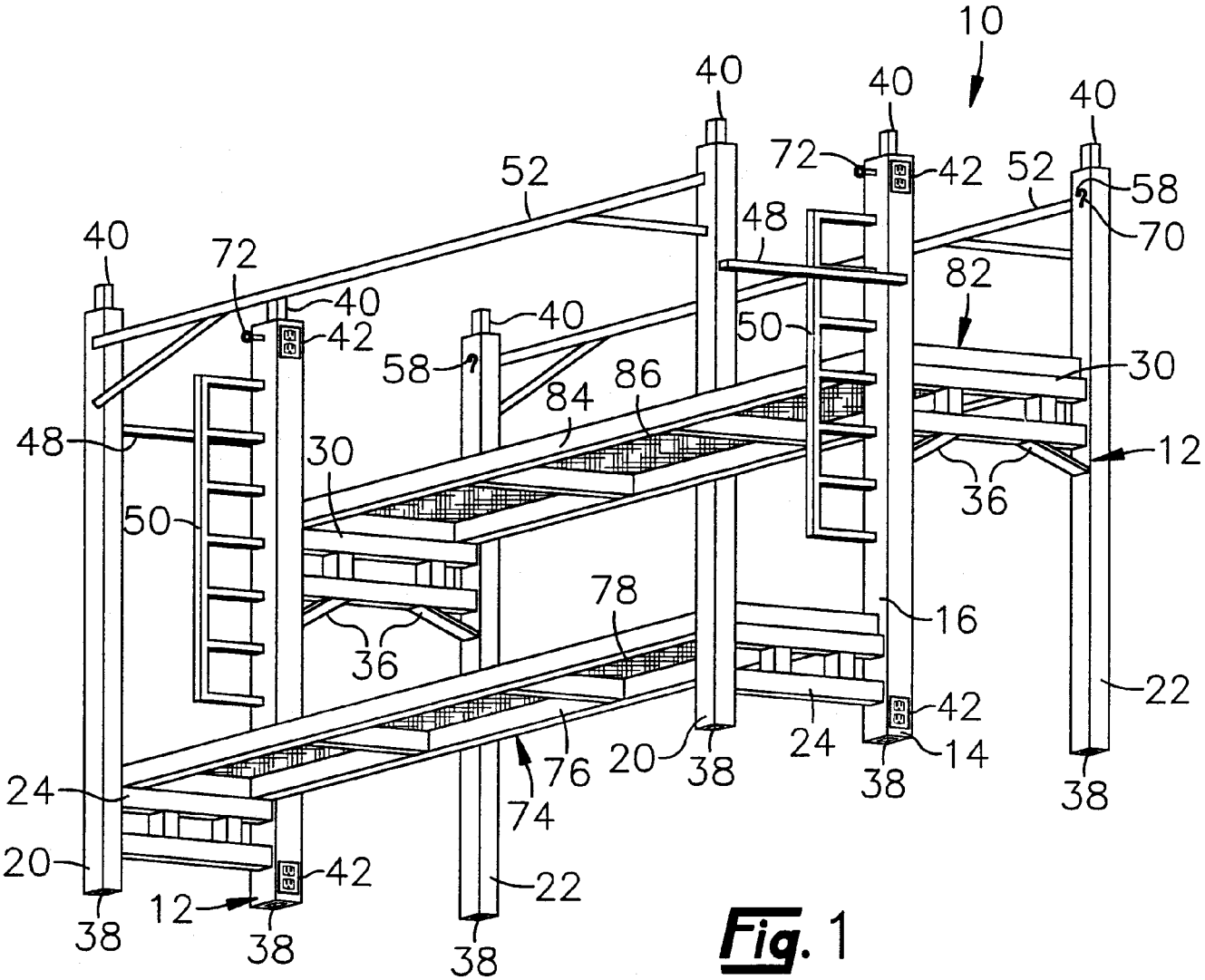
FIG. 1 is a perspective view of a section of scaffolding constructed in accordance with the present invention.

With reference now to the drawings in which like reference characters designate like or similar parts throughout the several views, FIG. 1 illustrates a section of an improved scaffolding 10 incorporating various features of the present invention. The improved scaffolding 10 is designed to include an integrated walk board 74 used to join successive pairs of end frames 12 such that problems typically associated with walk boards are avoided, with end frames 12 being constructed such that workers may freely walk between successive sections thereof along either of two walk-through areas of the scaffolding 10. Moreover, in a preferred embodiment of the present invention, a work board 82 is provided at an elevated location with respect to the walk board 74. Electrical power is provided to alleviate problems associated with dangling electric cords. Due to the configuration of the improved scaffolding 10, assembly and disassembly thereof is accomplished with greater efficiency when compared to the assembly and disassembly of prior art scaffolding.

The walk board 74 and work board 82 are each fabricated from a rigid material, preferably aluminum, with structural reinforcement included on the underside of the boards 74, 82 as needed. In an alternate embodiment, the walk board 74 and work board 82 are fabricated from a wooden plank or a plurality of wooden planks. The walk board 74 and work board 82 may be fabricated from other suitable materials as well, including plastic.

When raised or assembled, each section of the improved scaffolding 10 of the present invention includes a pair of end frames 12, a walk board 74, a work board 82, and handrail 52. Each end frame 12 is configured to be common to successive scaffolding sections. FIG. 1 illustrates, in perspective view, one section of the improved scaffolding 10 of the present invention.

Figure 2A:
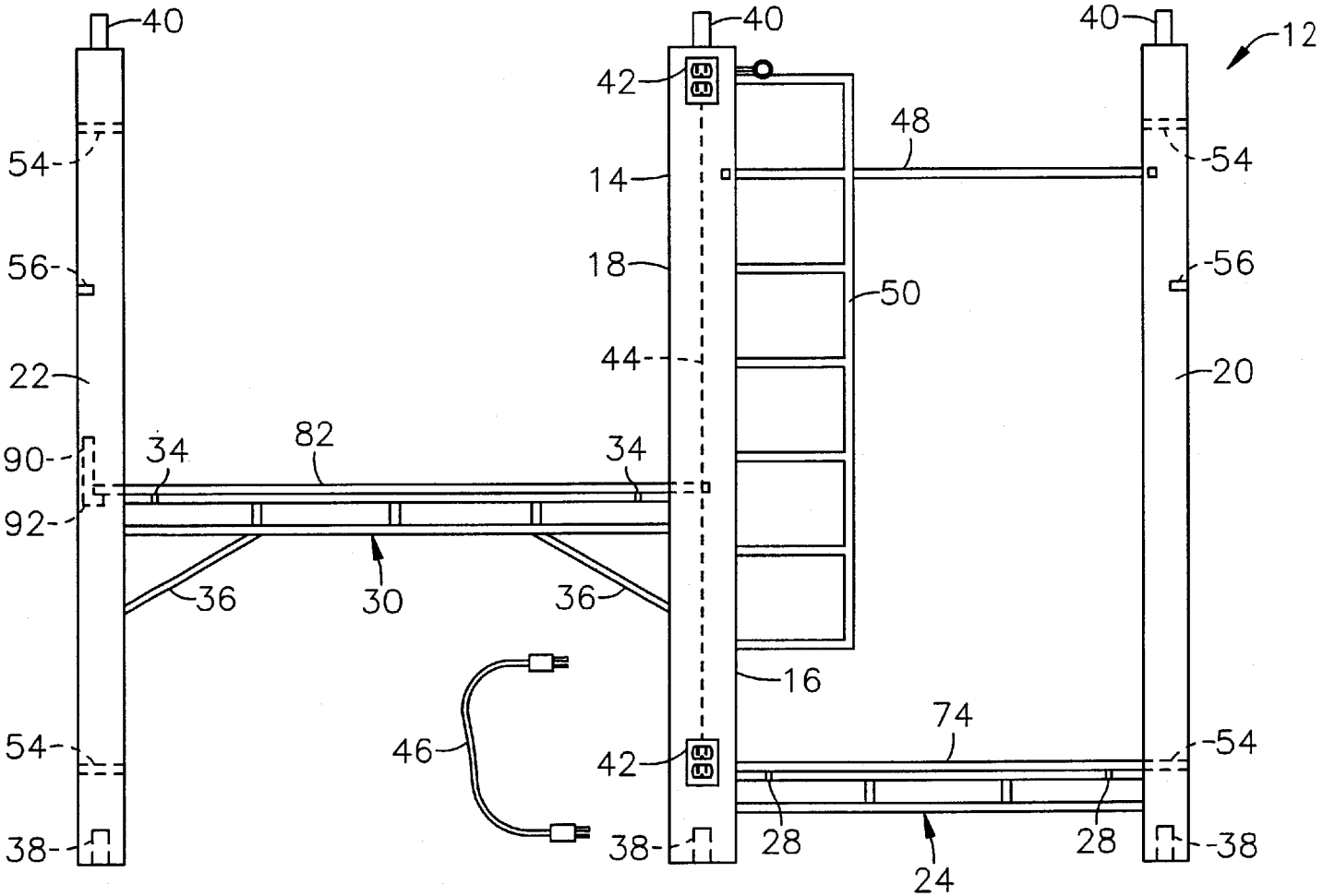
FIG. 2A illustrates an end elevation view of the scaffolding section shown in FIG.

As illustrated in FIG. 2A, each end frame 12 includes three compressive load bearing structural members, or columns, including a center column 14, a forward column 20, and a rearward column 22. The columns 14, 20, 22 are nonremovably attached to each other and combine to produce scaffolding having a walk-through area defined by that area bounded by the walk board 74, the forward column 20, and the center column 14 and a second walk-through area defined by that area bounded by the work board 72, the center column 14, and the rearward column 22. Although the center, forward, and rearward columns 14, 20, 22 exhibit square or rectangular cross-sectional dimensions for the embodiments shown in FIGS. 1–6, it will be understood that these columns, as well as other structural members of the scaffolding 10, may have a cross-sectional dimension which is circular, triangular, hexagonal, or other. Also, each column 14, 20, 22 is preferably fabricated as a continuous single column (unibody construction) to enhance and simply assembly of the scaffolding structure.

A walk board support 24 is mounted between the center and forward columns 14, 20, at the lower ends thereof. A work board support 30 is mounted between the center and rearward columns 14, 22 at an elevation above the walk board support 24. In the illustrated embodiment, the work board support 30 is disposed proximate the middle of the center and rearward columns 14, 22. In a preferred embodiment, the walk board and work board supports 24, 30 are permanently mounted between the respective forward, center and rearward columns 20, 14, 22. However, it will be understood that the walk board and work board supports 24, 30 may be adjustable in height, thus enabling the disposition of the walk board 74 and work board 82 to be variable.

To enhance stability of the end frame 12, brace members 36 are provided to extend between the rearward column 22 and the work board support 30 and between the work board support 30 and the center column 14 in order to form triangular configurations between the respective members. In the illustrated embodiment, the brace members 36 are permanently secured. However, it will be seen that in an embodiment as discussed above, wherein the work board support is adjustable, the brace members 36 are adjustable as well. It will further be seen that the brace members 36 may be disposed in similar fashion below the walk board support 24 in addition to or in lieu of the illustrated brace members 36.

Each of the lower and upper ends of the forward, center and rearward columns 20, 14, 22 defines an integral receptor 38 configured to closely receive a stud 40, which is integral with or inserted into the upper end of corresponding columns 20, 14, 22 of a further end frame 12. Accordingly, end frames 12 are stackable in an end to end fashion in order to accomplish multi-level scaffolding. As a safety precaution, locking pins may be provided for preventing the studs 40 from becoming dislodged from the receptors 38.

Electrical outlets 42 are preferably provided at each end of the center column 14 for powering electrical equipment. In the embodiment shown in FIG. 1, wiring 44 is disposed within the center column 14, with a pair of outlets 42 disposed at each end of the center column 14. A jumper 46 which includes an electrical cord having oppositely disposed male ends is provided for establishing electrical continuity between successive pairs of end frames 12. When the bottom end frame 12 is connected to a power source, and jumpers 46 are attached between the end frames 12, an outlet 42 disposed at each of the upper and lower ends of each end frame 12 is provided with electricity.

An end handrail 48 is secured between the upper ends of the forward and center columns 20, 14. In a preferred embodiment, the end handrail 48 is removably mounted in a conventional manner such that it may be placed only at the ends of each run of scaffolding 10. By providing the end handrail 48 only at the ends of a run of scaffolding 10, movement between each section of scaffolding 10 is unencumbered. However, it will be seen that the handrail 48 may be permanently mounted to each end frame 12 in a conventional manner.

Figure 2B:
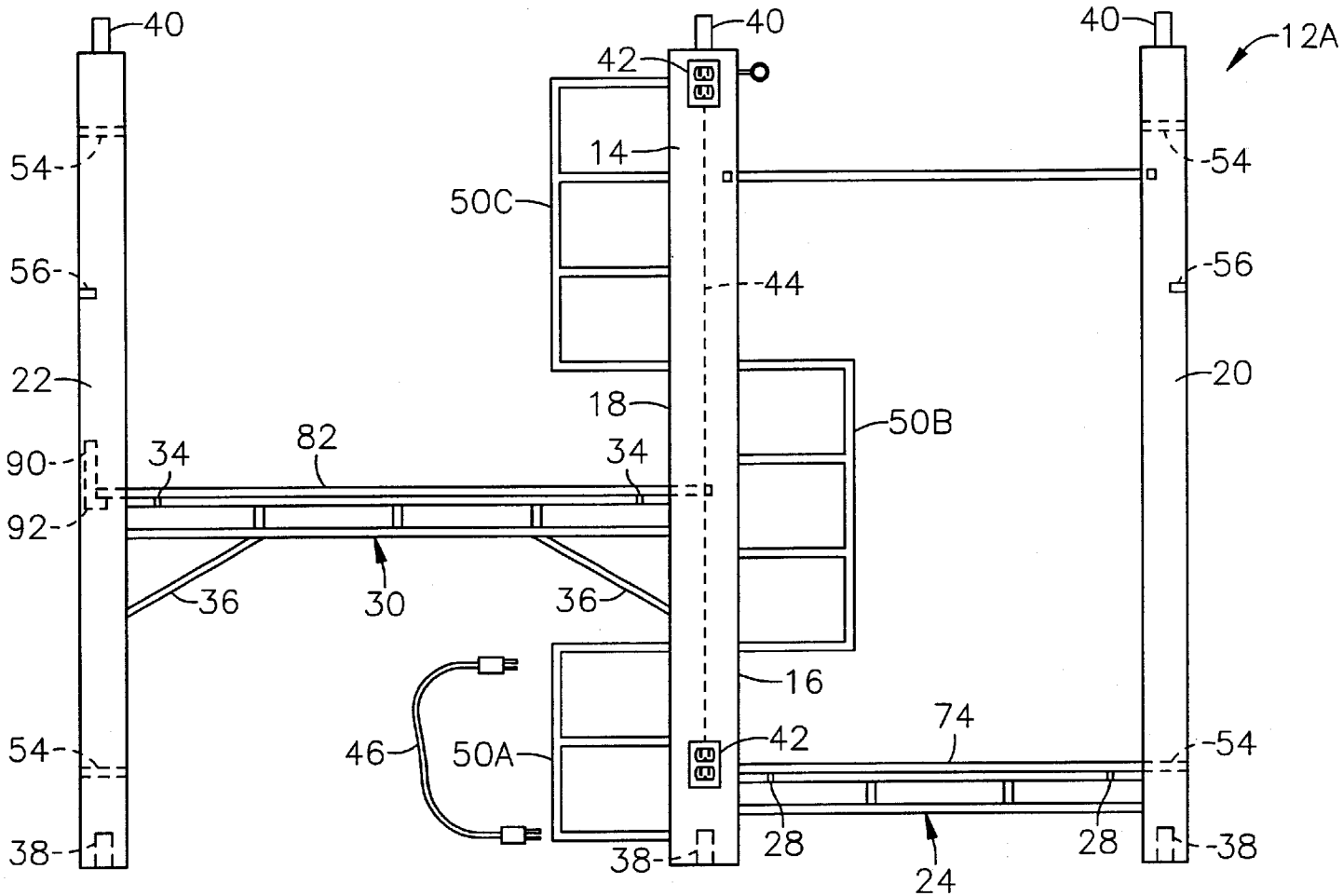
FIG. 2B illustrates an end elevation view of an alternate embodiment of a scaffolding end frame in accordance with the invention.

A ladder 50 is carried by the end frame 12, preferably on the forward side of the center column 14 such that a worker ascending or descending the ladder 50 may easily access the walk board 24 or work board 30 at the desired scaffold level. Alternatively, the ladder 50 is attached to the forward column 20 or the rearward column 22. In a preferred embodiment, the ladder 50 is permanently mounted on the end frame. However, as in the above instances, the ladder may be removable if desired. As illustrated in FIG. 2B, the ladder 50 in an alternate embodiment includes a first ladder portion 50A carried on the rearward side 18 of the center column 14 below the work board support 30, a second ladder portion 50B carried on the forward side 16 of the center column 14 above the first ladder portion 50A, and a third ladder portion 50C on the rearward side 18 of the center column 14 above the second ladder portion 50B. While some degree of stiffness may be added to the center column 14 by the presence of the ladder 50, 50A–C, the ladder 50, 50A–C is considered to be non-loading bearing in the sense that the absence of the ladder imposes substantially no effect to the structural integrity of the end frame. Instead, the only significant loading carried by the ladder 50, 50A–C are loads imparted to the ladder 50, 50A–C when the ladder 50, 50A–C is in use by a worker.

Figure 7:
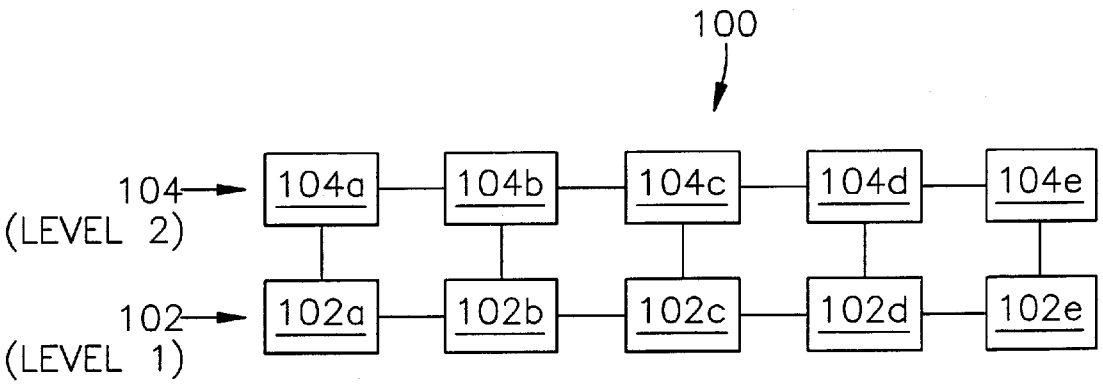
FIG. 7 is a functional block diagram of a multi-section scaffolding structure in accordance with the invention.

FIG. 7 illustrates in block diagram form a multi-section scaffolding structure 100 in accordance with the invention. The particular scaffolding structure of FIG. 7 includes five sections of scaffolding on each of two levels 102, 104 where each section 102*a–e*, 104*a–e* of the structure 100 is constructed and raised in accordance with the section of scaffolding 10 shown in FIG. 1. At each level of the structure, contiguous sections of scaffolding 10 share a common walk board support 24 and a common work board support 30. In a preferred embodiment, the end frames 12 for all intermediate sections 102*b–d*, 104*b–d* of the structure 100 do not include a ladder 50 since a ladder 50 at these sections of scaffolding would tend to serve as an obstruction to movement of workers and materials between successive sections of scaffolding. If desired, however, all end frames 12 of the structure 100 may include ladders.

As will be discussed in more detail below, the lower end of the rearward column 22 defines a through opening 54 for mounting a handrail 52 on intermediate layers of scaffolding 10. A through opening 54 is also defined at the upper end of the rearward column 22 for mounting a support brace 62 associated with a handrail 52 mounted to the intermediate runs of scaffolding 10, or for mounting a handrail 52 on the top run of scaffolding 10. A receptor 56 is defined a distance below the upper through opening 54 for mounting a support brace 62 associated with the handrail 52 on the top run of scaffolding 10. The spacing between the upper through opening 54 and the receptor 56 is equal to the spacing between the lower through opening 54 on a first end frame 12 and the upper through opening 54 on a second end frame 12 disposed immediately below the first. An upper through opening 54 and a receptor 56 are also defined by the upper end of the forward column 20 for mounting a handrail 52 on each run of scaffolding 10.

An eyelet, preferably an eye bolt 72, is provided at the upper end of each center column 14 for receipt of a safety cable. The safety cable is threaded through each eye bolt 72 along a run of scaffolding 10. Workers are then tethered to the safety cable in a conventional manner. By disposing the eye bolt 72 at an upper end of the center column 14, the worker wearing a harness tethered to the safety line is less likely to become entangled.

Figure 4:
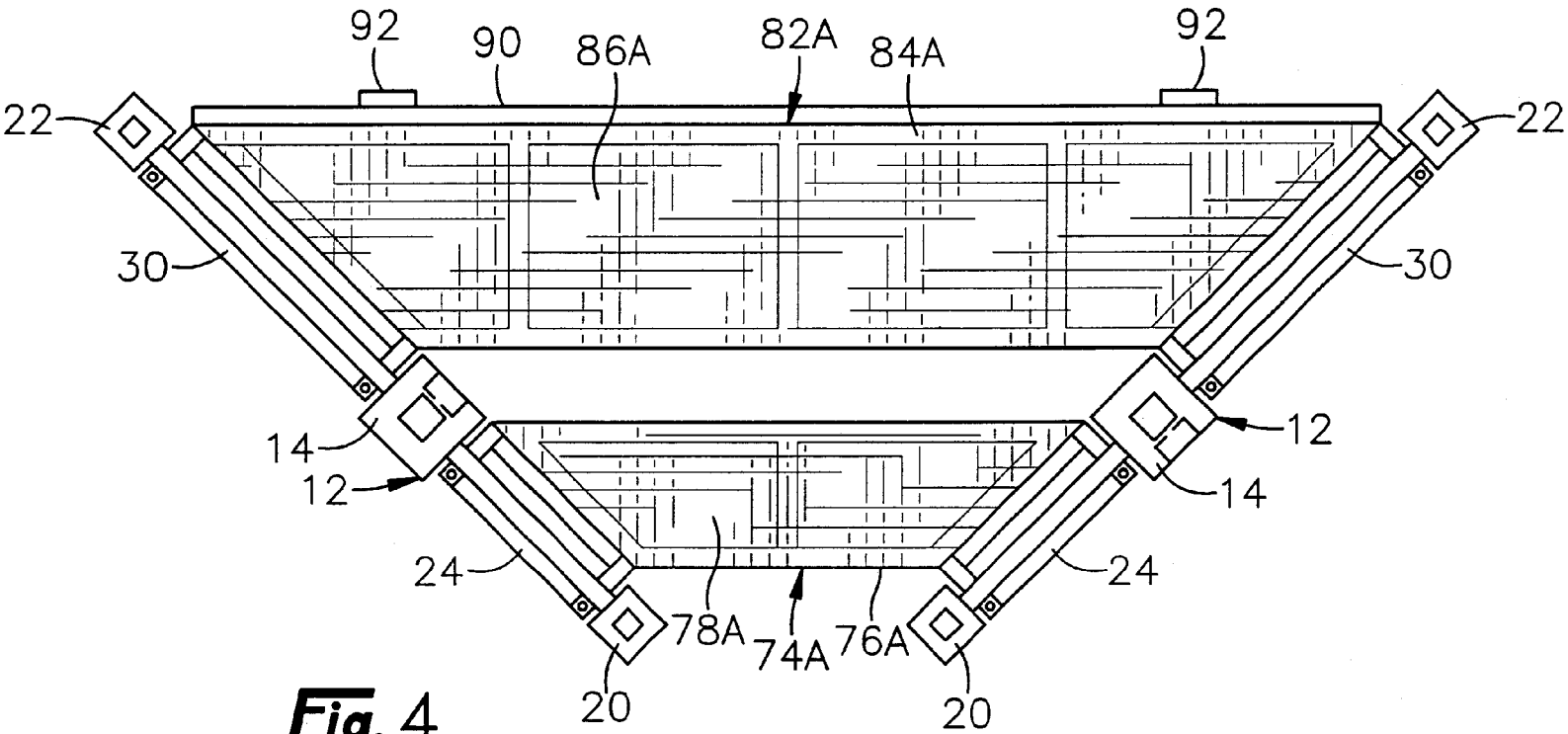
FIG. 4 is a top plan view of a corner walk board and work board for a scaffolding structure in accordance with the invention.

The walk board 74 and the work board 82 are each constructed in similar fashion to each other. In the illustrated embodiment, each includes a frame 76, 84 constructed from tubular steel and a support surface 78, 86 fabricated from a selected grating material. A toe board 90, best illustrated in FIG. 4, is provided for attachment to the rearward side of the work board 82, thus providing a means for preventing items from being pushed off of the work board 82. As illustrated in FIG. 4, the toe board 90 is mounted on the work board 82 in a conventional manner such as by clamping. A handrail may also be mounted to the work board using the clamps 92 shown to mount the toe board 90.

Figure 3:
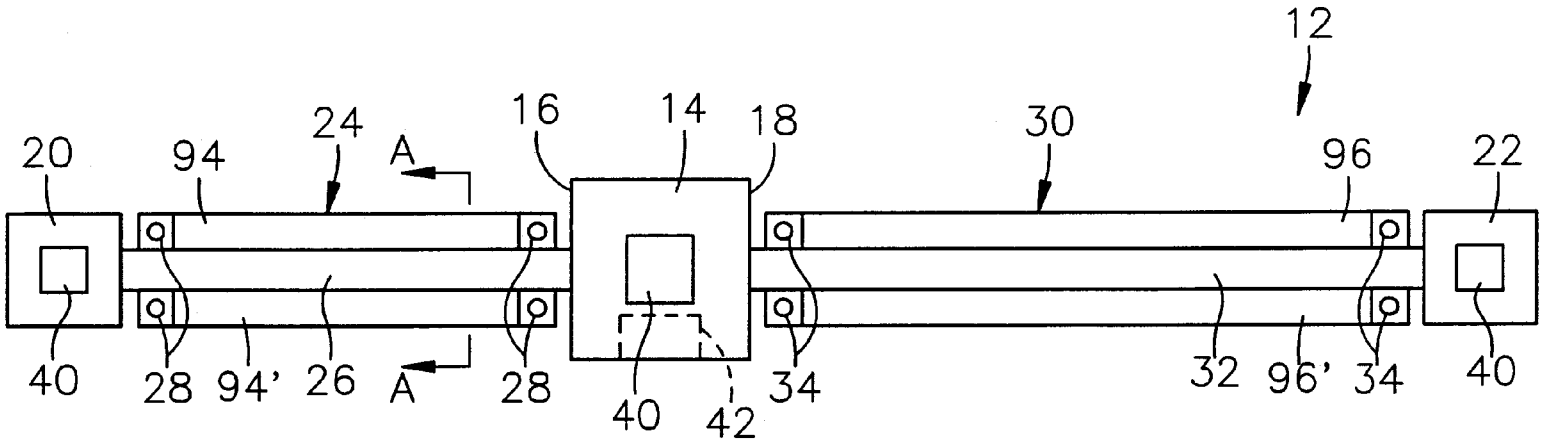
FIG. 3 is a top plan view of an end frame for use with the scaffolding section shown in FIG. 1.
Figure 8:
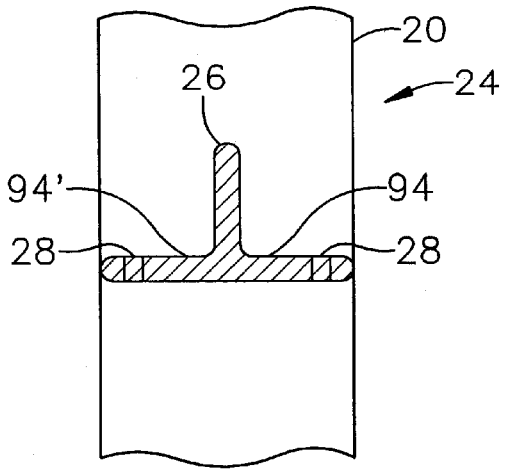
FIG. 8 is a cross-sectional view of the walk board support shown in FIG. 3 taken along line A—A.
Figure 9:
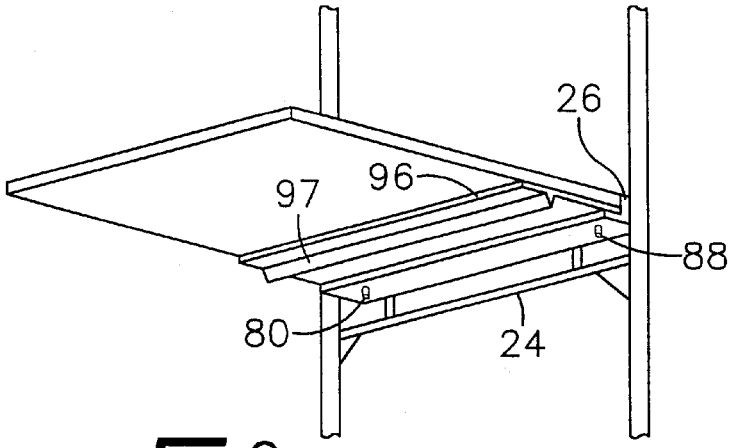
FIG. 9 is an elevated sectional view of a walk board joined with a walk board support.

FIG. 3 is a top plan view of an end frame 12 in accordance with the invention showing the walk board support 24 and the work board support 30, and FIG. 8 is a cross-sectional view of the walk board support 24 shown in FIG. 3 taken along cross-section line A—A, it being understood that a cross-section of the work board support 30 is similar to or the same as the cross-sectional view of the walk board support 24 shown in FIG. 8. As can be seen, each walk board and work board support 24, 30 is provided with two horizontal support members 94, 94', 96, 96' separated by a raised vertical support member 26, 32, thereby forming a T-shaped cross-sectional dimension as shown in FIG. 8. The ends of the boards are supported by the horizontal support members 94, 94', 96, 96' and the length of the vertical support members 26, 32 is preferably the same as or slightly less than the thickness of the boards so that when the boards are positioned end to end in the board support 24, 30 the board ends are flush with respect to one another and provide a safe, smooth walking surface with no overlap of the board ends. A plurality of receptors 28, 34 are provided in each horizontal support member 94, 94', 96, 96' for receiving mounting studs 80, 88 (FIG. 9) carried at the ends of each walk board 74 and work board 82 so that the board 74, 82 remains fixed with respect to the horizontal support member 94, 94', 96, 96'.

Figure 11:
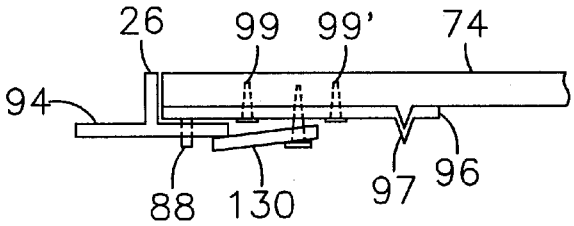
FIG. 11 is a side sectional view of a walk board, stiffener plate, and walk board support in accordance with the invention.

In a preferred embodiment, the mounting studs 80, 88 extend from a stiffener plate 98 (shown in FIGS. 9 and 11) attached to the underside of both ends of the walk board 74 and the work board 82. The stiffener plate 98 is particularly advantageous for use with wooden boards 74, 82 and is easily attached thereto with wood screws 99, 99' or other suitable fastener. The stiffener plate 98, which is preferably constructed from a stiff, durable, corrosion-resistant material such as aluminum, helps to distribute load forces exerted on the ends of the boards 74, 82, reduces flexing of the boards 74, 82, and provides a hard, durable, wear-resistant surface contact with the board supports 24, 30. The stiffener plate also includes a corrugation 97 to enhance stiffness.

From the above-described construction, it can be seen that assembly and disassembly of the improved scaffolding 10 of the present invention is performed quickly and efficiently.

Although several methods may be followed to assemble the improved scaffolding 10, one preferred method is to secure one end of a walk board 74 to a walk board support 24 of one end frame 12. Then the other end of the walk board 74 is secured to the walk board support 24 of a second end frame 12. A work board 82 is then secured at either end to the respective work board supports 30 of the two end frames 12. Locking pins 68 are put in place where required. Handrail 48, 52 is then mounted as required. As described above, multi-level scaffolding is raised by vertical stacking of end frames through use of studs 40 received in the receptors 38 at the ends of each end frame 12.

To establish continuous scaffolding 10 around corners of structures, a corner walk board 74A and a comer work board 82A are provided, as shown in FIG. 4. Each corner walk board 74A and corner work board 82A defines first and second ends disposed at a right angle with respect to each other. Each end, however, is configured to be substantially similar to the respective ends of the walk board 74 and work board 82 shown in FIG. 1. Although not shown, the corner walk board 74A and work board 82A may be adjustable to accommodate for varied spacing of the straight runs of scaffolding to which they attach. Adjustment of the length of the corner walk board 74A and corner work board 82A is accomplished by constructing each to include two telescoping members.

Figure 5:
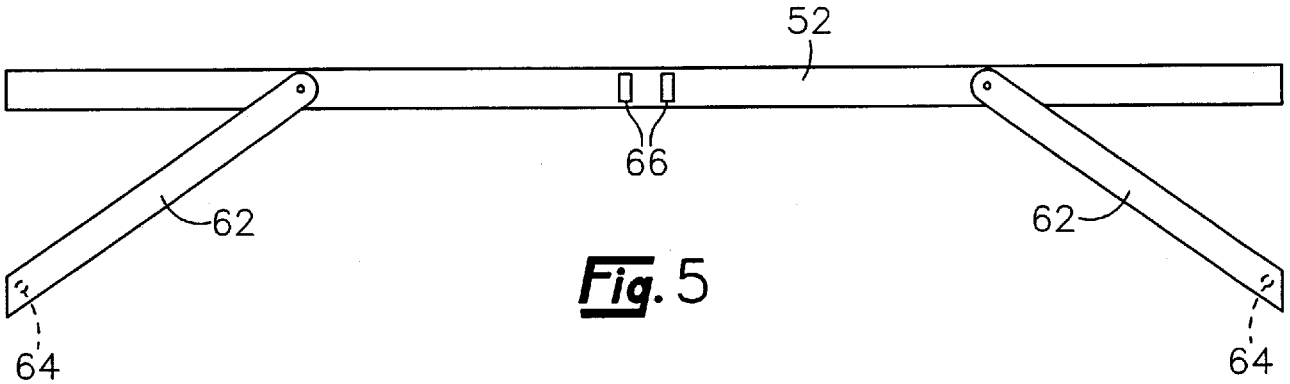
FIG. 5 is a front elevation view of a handrail for use with the scaffolding section shown in FIG. 1.

FIG. 5 illustrates the handrail 52 mounted at the upper end of the top run of scaffolding 10 on the rearward columns 22, at the lower end of each intermediate run of scaffolding 10 on the rearward columns 22, and at the upper end of each run of scaffolding 10 on the forward columns 20. The support braces 62 are pivotally mounted at one end on the handrail 52 as shown. A locking pin 68 (FIG. 6) is carried by the free end of each mounting brace 62 for being received with either the upper through opening defined by the rearward column 22 or the receptor 56 defined by either of the rearward or forward columns 22, 20, depending upon the disposition of the handrail 52. When the handrail 52 is not in use, the locking pin 64 carried by the mounting brace 62 free end may be received within a receptor 66 defined proximate the middle of the handrail 52.

Figure 6:
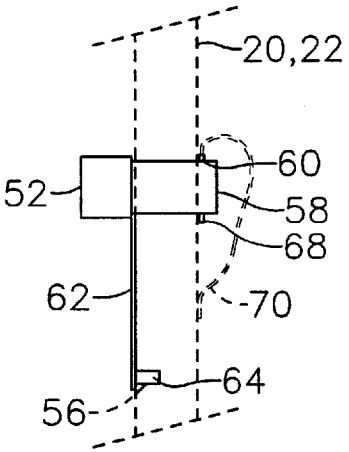
FIG. 6 is an end elevation view showing the connection of the handrail of FIG. 5 to an end frame.

As can be more clearly seen in FIG. 6, the handrail 52 defines a mounting stud 58 configured to be closely received within either of the through openings 54 defined by the rearward column 22 upper and lower ends and the forward column 20 upper end. A pin receptor 60 is defined at the distal end of the handrail mounting stud 58. The pin receptor 60 is disposed such that when the handrail mounting stud 58 is received within a through opening 54, a locking pin 68 is received with the pin receptor 60, and the mounting brace locking pin 64 is received within a through opening 54 or receptor 56, the mounting brace 62 is tensioned to bias the handrail 52 away from the end frame 12. In so doing, movement of the handrail 52 with respect to the end frames 12 is inhibited.

The mounting stud locking pin 68 is equipped with a securement device 70 for permanently securing the locking pin 68 to the end frame 12. In the illustrated embodiment, one end of a cable is mounted on the end frame 12, such as by welding, with the other end of the cable being secured to the locking pin 68. It will be seen that other embodiments of the securement device 70 may be incorporated as well. By providing a securement device 70 such as that described, it will be seen that the locking pins 68 will not get lost, which is the tendency in a conventional scaffolding system.

Figure 10:
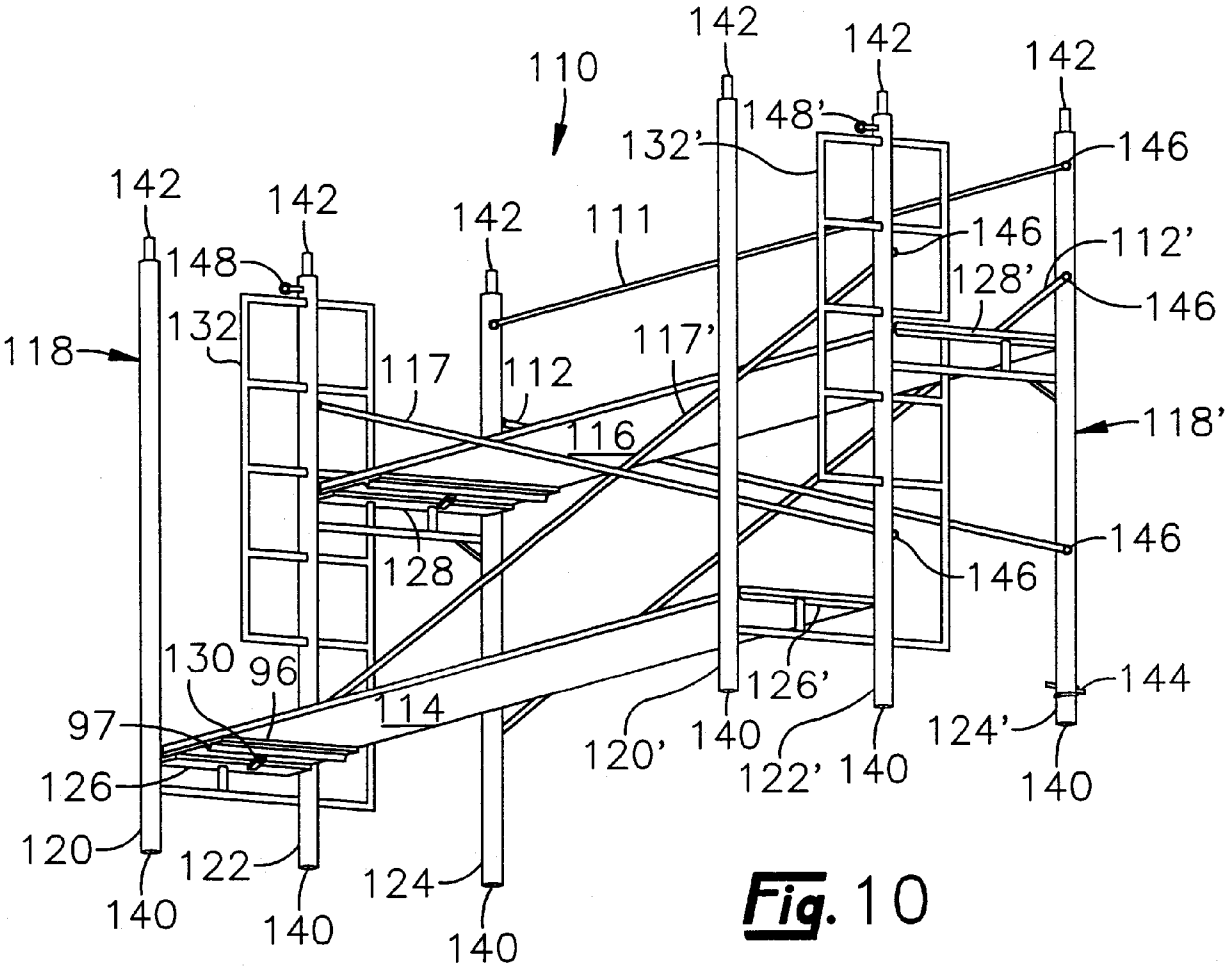
FIG. 10 is a perspective view of an alternate embodiment of a scaffolding section constructed in accordance with the present invention.

FIG. 10 shows an alternate embodiment of a dual walk-through section of scaffolding 10 in accordance with the invention which includes a walk board 114, a work board 116, end frames 118, 118', a handrail 111, rearward column cross-bracing 112, 112', and center column cross-bracing 117, 117'. In this embodiment, the side handrail 52 of FIG. 1 is eliminated and a standard handrail 111 commonly used in conventional scaffolding is employed when needed. Cross-braces 112, 112', 117, 117', which are provided to enhance structural stability and integrity, are also standard cross-braces commonly used in conventional scaffolding. The handrail 111 and cross-braces 112, 112', 117, 117' each include through openings at their opposed ends. The through openings of the handrail 111 and cross-braces 112, 112' are received by studs 146 attached to the rearward columns 124, 124'. The through openings of cross-braces 117, 117' are received by studs 146 attached to the center columns 122, 122'. Eyelets 148, 148' are provided to receive a safety cable or rope.

The extent to which cross-bracing is needed for scaffolding constructed in accordance with the invention depends upon the amount of loading imposed on the structure, including loading resulting from the weight of workers and materials, multi-level stacking of scaffolding, wind, and other forces. Generally, the greater the loading the greater the need for cross-bracing. Under moderate loading conditions, a single conventional type cross-brace at each section of scaffolding 10 may provide sufficient cross-bracing to prevent collapse of the scaffolding 110. In a preferred embodiment, two cross-braces 112, 112' connected to the rearward columns 124, 124' and two cross-braces 117, 117' connected to the center columns 148, 148' provide ample cross-bracing for normal loading conditions. Thus, there are no cross-braces connected to the forward columns 120, 120' on the working side of the scaffolding 10 to restrict a worker's access to the work area. If desired, however, cross-braces may be attached between the forward columns 120, 120'.

In an alternate embodiment, conventional type cross-braces 112, 112' connecting the rearward columns 124, 124' and conventional type cross-braces 117, 117' connecting the center columns 122, 122' are eliminated and cross-bracing of the scaffolding 110 is provided by cross-bracing members connected to the walk board 114 and work board 116 and one or more of the end frame columns 120, 120', 122, 122', 124, 124'. For example, four cross-bracing members may be connected between the walk board 114 and the forward and center columns 120, 120', 122, 122', and four cross-bracing members may be connected between the work board 116 and the center and rearward columns 122, 122', 124, 124'.

As described above with regard to FIGS. 1, 2A, and 2B, electrical power may be provided to the end frames of the scaffolding 110. Also, as previously described, receptors 140 formed in the lower ends of the columns 120, 120' 122, 122', 124, 124' are sized to closely receive a stud 142 carried by or inserted in the upper ends of corresponding columns 120, 120' 122, 122', 124, 124' so that end frames 118, 118 can be stacked to achieve a multi-level scaffolding structure. If desired, locking pins 144 or similar locking devices may be used to inhibit or prevent the studs 142 from becoming dislodged from the receptors 38. At each level of the structure, contiguous sections of scaffolding 110 share a common walk board support 126, 126' and a common work board support 128, 128'.

Each end frame 118, 118' includes a forward column 120, 120', a center column 122, 122', and a rearward column 124, 124'. Walk board supports 126, 126' are employed to interconnect the forward column 120, 120' with the center column 122, 122' and to support opposed ends of the walk board 114. Work board supports 128, 128' are employed to interconnect the center column 122, 122' with the rearward column 124, 124' at an elevated position with respect to the position of the walk board support 126, 126' so that when the work board 116 is attached to the work board supports 128, 128' and the walk board 114 is attached to the walk board supports 126, 126' in the manner described above with regard to FIGS. 8, 9, and 11, the work board 116 is maintained at an elevation above the walk board 114. Keepers 130 are provided at the ends of the walk board 114 and work board 116 to inhibit vertical displacement of the boards 114, 116, as may occur during high-level wind updrafts.

A ladder 132, 132' configured as shown, is attached to the center columns 122, 122' of each each frame 118, 118'. As previously described with respect to the ladders 50, 50A–C of FIGS. 1 and 2B, the ladder 132 of FIG. 10 is preferably non-load bearing and carries significant loads only when in use by a worker. The ladder 132 is permanently attached to the center column 122, 122' in a preferred embodiment but may be detachable if desired. The ladder 132 of FIG. 10 also meets applicable industry standards including OSHA standards.

From the foregoing description, it will be recognized that a scaffolding system offering significant advantages over the prior art has been provided. Among these advantages are a three-column structural support configuration which provides enhanced stability and load distribution and dual walk-through work areas, special structural support members for support of walk boards and work boards to reduce or eliminate hazards associated with unsecured and overlapped boards, an integral, non-load bearing ladder which meets applicable OSHA standards, a walk board level and a work board level which is elevated with respect to the walk board level to optimize positioning and accessibility of workers and materials, and elimination of cross braces on the working side of the scaffolding to enhance accessiblity to work areas. The scaffolding is also designed to enable workers to easily and safely move between successive sections of the scaffolding. Electrical power provisions are integrated with the scaffolding structure to alleviate problems and hazards associated with dangling electrical cords. Due to the configuration of the scaffolding system, assembly and disassembly thereof is accomplished with greater efficiency when compared to the assembly and disassembly of prior art scaffolding.

It is contemplated, and will be apparent to those skilled in the art from the foregoing specification, drawings, and examples that modifications and/or changes may be made in the embodiments of the invention. Accordingly, it is expressly intended that the foregoing are illustrative of preferred embodiments only, not limiting thereto, and that the true spirit and scope of the present invention be determined by reference to the appended claims.

What is claimed is:

1. A scaffolding end frame comprising:

a forward scaffolding column having an upper end in opposed relation to a lower end;

a center scaffolding column having an upper end in opposed relation to a lower end;

a rearward scaffolding column having an upper end in opposed relation to a lower end;

a first board support member attached to said forward scaffolding column and said center scaffolding column, said board support member being configured to receive a substantially planar scaffolding board; and a second board support member attached to said center scaffolding column and said rearward scaffolding column, said board support member being configured to receive a substantially planar scaffolding board;

wherein said upper and lower ends of each column including means for connecting the column to an upper or lower of a corresponding column of a further end frame for vertical stacking of end frames, said forward, center, and rearward scaffolding columns lying in a common plane and said board support members and said scaffolding column are integrally formed, each of said scaffolding columns being of substantially equal length and extending below said board support members to act as feet.

2. The end frame of claim 1 wherein said forward, center, and rearward scaffolding columns are substantially parallel to each other.

3. The end frame of claim 1, further comprising:

said first board support member being connected to said center scaffolding column at a first distance from the lower end of the center scaffolding column; and said second board support member being connected to said center scaffolding column at a second distance from the lower end of the center scaffolding column which is greater than said first distance.

4. The end frame of claim 1, further comprising a ladder attached to said center scaffolding column for use in ascending and descending a scaffolding structure comprised of said end frame.

5. The end frame of claim 4 wherein said ladder is non-load bearing such that the absence of said ladder imposes substantially no effect to the structural integrity of the end frame.

6. The end frame of claim 4 wherein said ladder includes a plurality of uniformly spaced rungs wherein successive ones of said plurality of uniformly spaced rungs are separated by a distance no greater than sixteen and three quarters inches.

7. The end frame of claim 1 wherein said center and rearward scaffolding columns include a plurality of studs for receiving cross-braces used in cross-bracing said scaffolding end frame with a further end frame.

8. The end frame of claim 1 wherein each of said upper and lower ends of the forward, center, and rearward columns include a receptor for receiving a stud for use in vertical stacking of further end frames.

9. The end frame of claim 1, further comprising an eyelet attached to said scaffolding end frame for receiving a safety cable.

10. The end frame of claim 1, further comprising:

an electrical outlet carried by one of the scaffolding columns; and an electrical conduit disposed within said one of the scaffolding columns for establishing electrical continuity between a power source and the electrical outlet.

11. A scaffolding structure comprising:

first and second end frames, each of said first and second end frames including:

a forward scaffolding column having an upper end in opposed relation to a lower end;

a center scaffolding column having an upper end in opposed relation to a lower end;

a rearward scaffolding column having an upper end in opposed relation to a lower end;

a walk board support attaching the forward scaffolding column and the center scaffolding column; and a work board support attaching the center scaffolding column and the rearward scaffolding column;

wherein each of said scaffolding columns and said board supports are integrally formed, each of said scaffolding columns extending below said board supports to act as feet;

a walk board having opposed ends interconnecting the walk board supports of said first and second end frames;

a work board having opposed ends interconnecting the work board supports of said first and second end frames; and means for cross-bracing said first end frame relative to said second end frame.

12. The scaffolding structure of claim 11 wherein said means for cross-bracing includes a cross-brace having opposed ends with one end attached to the rearward column of the first end frame and the other end attached to the rearward column of the second end frame.

13. The scaffolding structure of claim 11, further comprising a ladder attached to said first end frame for ascending and descending the scaffolding structure.

14. The scaffolding structure of claim 13 wherein said ladder is non-load bearing such that the absence of said ladder imposes substantially no effect to the structural integrity of the first end frame.

15. The scaffolding structure of claim 13 wherein said ladder includes a plurality of rungs wherein successive ones of said plurality of rungs are separated by a distance no greater than sixteen and three quarters inches.

16. The scaffolding structure of claim 11, further comprising a handrail having a first end connected to said first end frame and a second end connected to said second end frame.

17. The scaffolding structure of claim 11 wherein each end of said walk board and said work board includes a stiffener plate for interfacing the ends of the boards with the end frames.

18. The scaffolding structure of claim 11 wherein said means for connecting said upper and lower ends of the scaffolding columns include a plurality of receptors for receiving a plurality of studs for use in vertical stacking of further end frames.

* * * * *